United States Patent [19]

Mieyal

[11] 4,443,991

[45] Apr. 24, 1984

[54] DEMOUNTABLE PARTITION STRUCTURE

[75] Inventor: David F. Mieyal, Strongsville, Ohio

[73] Assignee: Donn, Incorporated, Westlake, Ohio

[21] Appl. No.: 195,411

[22] Filed: Oct. 9, 1980

[51] Int. Cl.[3] ..... E04B 2/78

[52] U.S. Cl. ..... 52/729; 52/242; 52/481

[58] Field of Search ..... 52/232, 238, 241, 481, 52/729, 242

[56] References Cited

U.S. PATENT DOCUMENTS

| | | | |
|---|---|---|---|
| 2,154,520 | 4/1939 | Mackin . | |
| 3,027,605 | 4/1962 | Nelsson . | |
| 3,125,193 | 3/1964 | Brown | 52/481 |
| 3,548,557 | 12/1970 | Downing . | |
| 3,609,933 | 10/1971 | Jahn | 52/481 |
| 3,623,290 | 11/1971 | Downing . | |
| 3,712,015 | 1/1973 | Nelson . | |
| 3,729,883 | 5/1973 | Thompson . | |
| 3,732,657 | 5/1973 | Nelsson | 52/481 |
| 3,908,328 | 9/1975 | Nelsson . | |
| 3,998,027 | 12/1976 | Wendt . | |
| 4,152,878 | 5/1979 | Balinski | 52/481 |

*Primary Examiner*—John E. Murtagh

*Attorney, Agent, or Firm*—Pearne, Gordon, Sessions, McCoy, Granger & Tilberry

[57] ABSTRACT

A demountable wall system is disclosed providing metal studs adapted to be positioned along the joints between adjacent wall panels. The studs provide outer flanges which are positioned in kerfs along the edges of the panels and inner flanges which engage the inner surface of the panels. A U-shaped web system connects the inner flanges and is structured with the legs of the U-shaped web spaced from the adjacent flanges except at their extremities so that the legs cushion vibration or sound to minimize their transmission through the stud between the two sides of the wall. The inner flanges have a width exceeding twice the depth of the kerfs so that they engage panels beyond the kerf-weakened edges thereof.

6 Claims, 6 Drawing Figures

FIG. 3
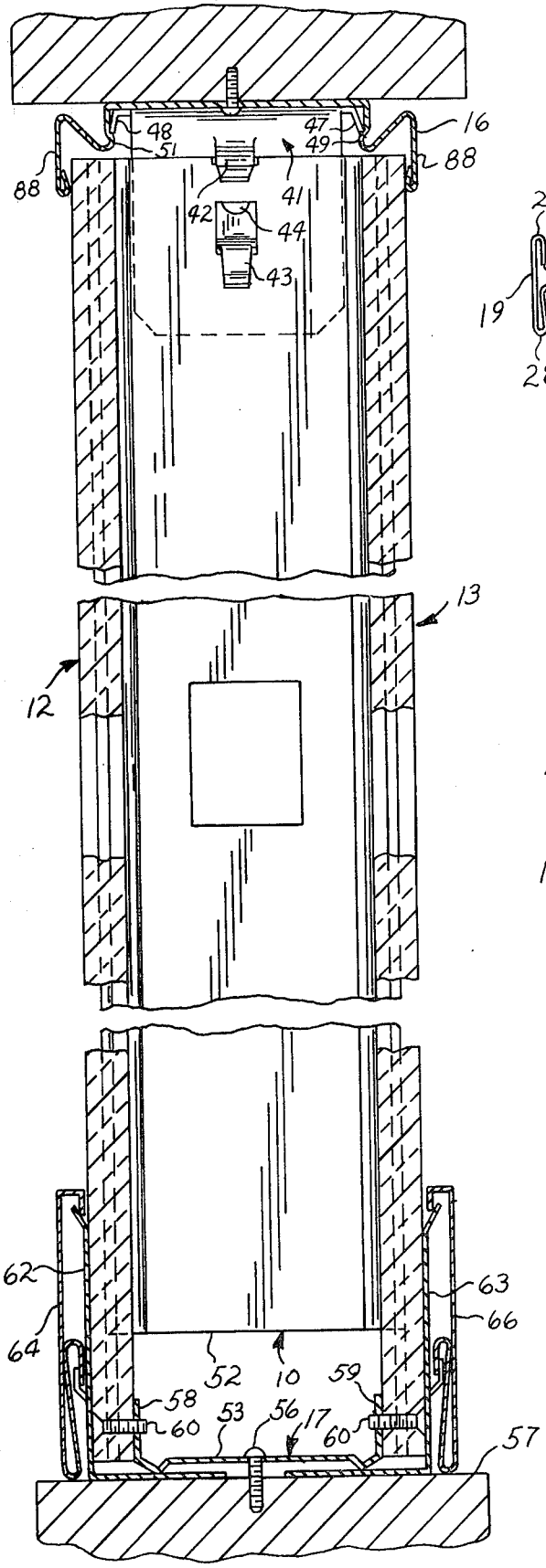
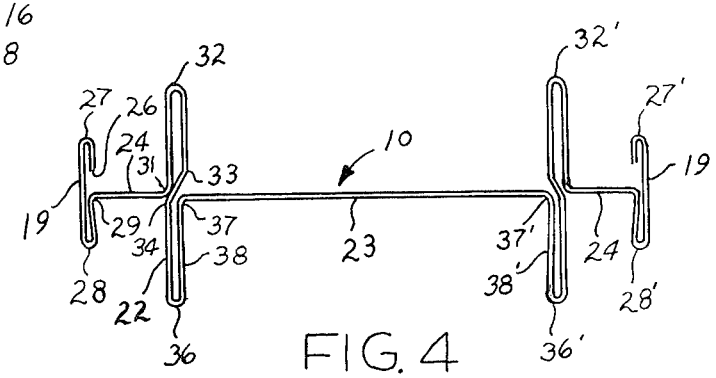
FIG. 4
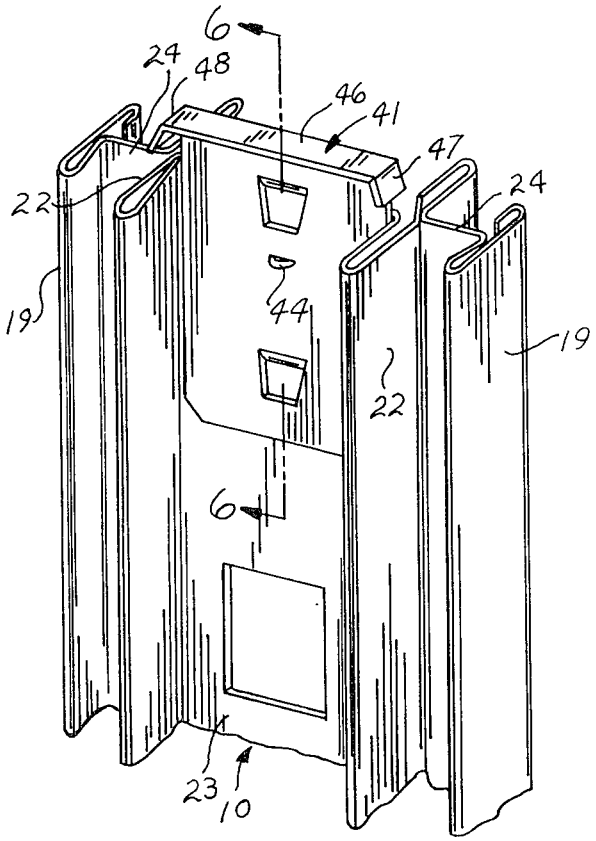
FIG. 5

DEMOUNTABLE PARTITION STRUCTURE

BACKGROUND OF THE INVENTION

This invention relates generally to partition structures and, more particularly, to a demountable partition structure utilizing novel and improved metal studs.

Prior Art

Demountable partition structures which utilize metal studs in combination with wallboards are known. Usually, such wallboards are gypsum sheets which are often surfaced with a sheet of decorative vinyl or the like. In some instances, the stud is provided with a flange which fits into a kerf cut in the panel edge to position and align the panels. Such partitions are usually referred to as demountable walls because the partitions are easily assembled and are relatively easily disassembled. Examples of such wall structures are described in U.S. Pat. Nos. 2,154,520; 3,027,605; 3,548,557; 3,623,290; 3,712,015; 3,729,883; 3,732,657; 3,908,328; and 3,998,027.

SUMMARY OF THE INVENTION

There are several important aspects of the present invention. In accordance with one aspect of this invention, a simplified demountable wall stud is provided in which the stud is structured to minimize sound or vibration transmission from one side of the wall to the other.

In the illustrated embodiment, the sound transmission reduction is accomplished by utilizing a generally U-shaped, central connecting web in which the legs of the U are in spaced adjacency to the inner wall surface flanges and are joined thereto at their extremities. The legs act as a spring cushion which minimizes any transmission of sound or other vibrations.

The stud is also suspended from the upper wall track by a simple mounting clip which snaps onto one end of the stud and which is snapped into the track. The structure provides for easy installation and allows the stud to slide lengthwise of the ceiling track into proper position after it is snapped into the ceiling track. The length of the stud is less than the spacing between the floor and ceiling tracks so that the lower end of the stud is spaced from the floor track of the system. Because of this spacing, variations in floor-to-ceiling spacing can be accommodated without on-site cutting of the studs.

The illustrated embodiment provides a stud with a pair of spaced flanges along each edge. One flange engages the back sides of the adjacent panels along the entire length of the stud and the other flange fits into kerfs along the edges of the panels to lock the panels in place. The inner or backing flanges are provided with a width exceeding twice the depth of the kerfs so that panel backing is provided along a panel zone beyond the edge portion containing the kerfs, which portion is inherently weakened by the existence of the kerfs. With this structure, a full backup is provided for the panels to provide maximum strength to resist forces applied to the wall.

These and other aspects of the invention will become more apparent from the following description and drawings.

BRIEF DESCRIPTION OF THE DRAWINGS

FIG. 3 is an enlarged, fragmentary cross section, taken along line 3—3 of FIG. 2, illustrating the mounting of one of the studs;

FIG. 4 is an enlarged cross section of the structure of the stud;

FIG. 5 is a fragmentary, perspective view illustrating a stud with the mounting clip mounted thereon.

DETAILED DESCRIPTION OF THE DRAWINGS

Figure 2:
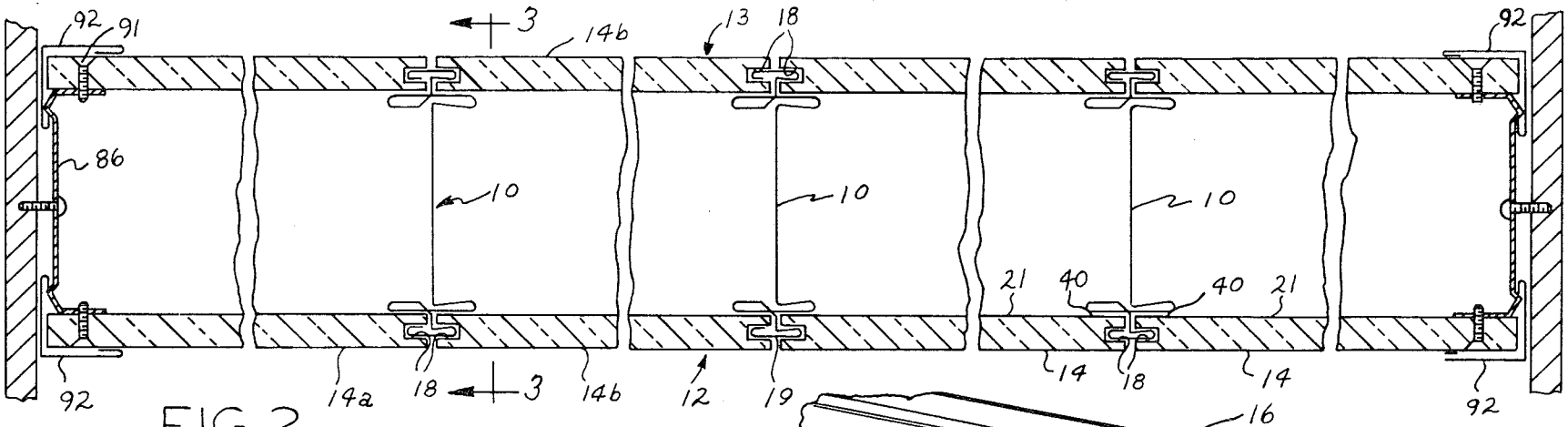
FIG. 2 is an enlarged, broken plan view of a typical wall structure with the studs installed therein.
Figure 1:
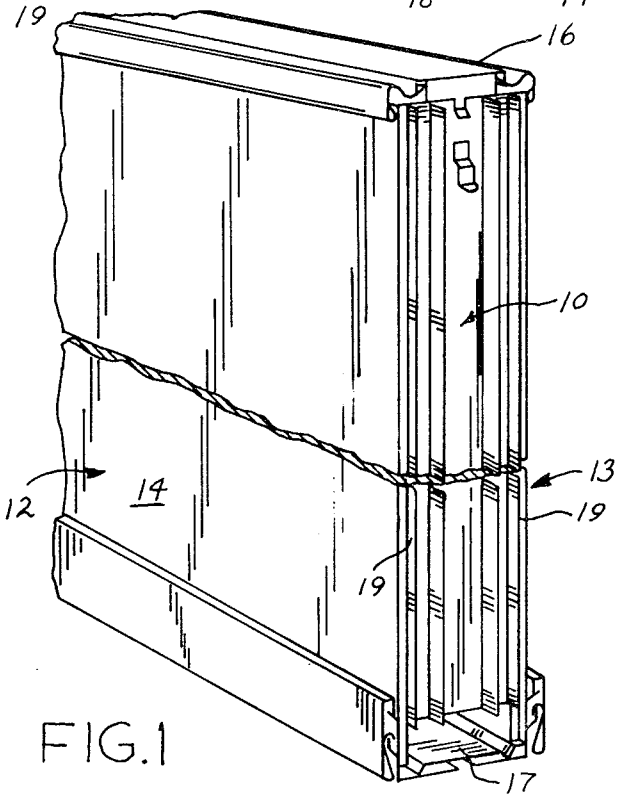
FIG. 1 is a fragmentary, perspective view, illustrating the general structure of the demountable wall at a stud.

FIGS. 1 and 2 illustrate an assembled wall system in accordance with the present invention. Such wall includes studs 10 which are positioned within a wall consisting of spaced and parallel rows 12 and 13 of edgewise abutting wallboard panels 14. In the illustrated embodiment, the wallboard panels are preferably formed of gypsum board provided with a surface covering of vinyl sheet material laminated to the board. In the drawings, no attempt has been made to illustrate the vinyl sheet material per se.

Mounted above the wall is a ceiling track or channel 16 into which the upper edges of the panels 14 project and which also provide the support for the upper ends of the studs 10. Located at the lower edge of the wall is a floor track assembly 17 described in detail below, and which connects to the lower edge of the panels 14.

The panels 14 are preferably formed with kerfs 18 along their adjacent edges to receive an outer flange 19 of an associated stud 10 to secure the panels to the stud and to ensure that the panels are maintained in proper alignment. The studs 10 are located along the joints between adjacent panels 14, with their outer flanges 19 positioned in the associated kerfs. In the illustrated embodiment in which outer flanges 19 are provided on both sides of the studs 10, the panels are positioned in alignment so that the joints between adjacent panels of one row are in alignment with the joints between the adjacent panels of the other row.

The studs are provided with a cross section, best illustrated in FIGS. 4 and 5. In addition to the outer flanges 19, the studs provide inner flanges 22 which are proportioned to engage the inner surfaces 21 of the panels 14 adjacent to the edges thereof. The studs 10 are also provided with a central web 23 which extends between the two inner flanges 22 and an outer web 24 which joins each of the outer flanges 19 to the adjacent inner flanges 22.

The stud is preferably formed by bending a single strip of relatively thin metal to the shape illustrated in the drawings. Starting from one edge at 26, the metal strip extends to a reverse bend at 27, and then to a second reverse bend at 28 to form the outer flange 19. From the bend at 28, the strip extends to a right angle bend 29, where the outer flange 19 joins the web 24. From the right angle bend 29, the metal extends to a second right angle bend 31 and from there to a reverse bend at 32. From the bend 32, the metal extends back toward the center of the stud to a slight bend at 33, and from there to a slight bend at 34, where the metal at the bend 34 engages the metal at the bend 31. From the bend 34, the metal extends along the same plane as the metal between the bends 31 and 32 to a reverse bend at 36 and back along the inner flange 22 to a right angle bend at 37.

It should be noted that the leg of metal 38 between the two bends 36 and 37 is spaced from the adjacent leg and that there is no physical contact between the metal at the bend 37 and the adjacent metal forming the flange 22. This structure in which the leg 38 is in spaced adjacency (i.e., not in contact with the adjacent parts of the flange 22) is an important feature of this invention, as discussed below. From the bend 37, the metal extends along the central web 23 to an opposite right angle bend at 37'. The remaining portions of the stud are formed as mirror opposites to the portions forming the outer flange 19 and inner flange 22 of the left side of FIG. 5, and similar reference numerals are used with a prime (') added to indicate reference to the right side of the stud and the formation of the outer and inner flanges along the right side of the stud.

Preferably, the stud is substantially symmetrical about a central plane along which the webs 23 and 24 extend, with the flanges 19 and 22 extending substantially perpendicular to and in opposite directions from the central plane. Similarly, the stud is symmetrical from left to right as viewed in FIG. 4 about a point at the center of the web 23.

The spacing between the edges of the center web 23 at 37 and the adjacent parts of the flanges 22 results in a structure in which there is no direct communication or connection for vibration or sound transmission between one inner flange 22 and the other inner flange 22. In effect, the inner flanges are connected by a U-shaped structure consisting of the center web 23 and the two legs 38 and 38', where the legs 38 and 38' act as cushioning springs to virtually eliminate any direct transmission of sound or vibration through the stud from one panel of one row to the corresponding panel of the adjacent row. Thus, with the simple expedient of providing a slight gap between adjacent parts of the stud, it is possible to greatly reduce the sound transmission through a wall by the metal stud.

The inner flanges 22 have a width which is greater than the width of the outer flanges 19 and greater than twice the depth of the kerfs 18. Therefore, the inner flange 22 engages a zone 40 of the adjacent panels along the entire length of the studs, beyond the kerfs where the panels are not weakened by the existence of the kerfs. Since most forces applied to a wall panel are in a direction toward the interior of the wall, this full backup of the wall panel along an unweakened portion thereof provides a strong structure which is capable of resisting such loads.

The outer flanges also extend along the entire length of the panels and, even though they engage a portion of the panel weakened by the existence of the kerfs 18, provide sufficient strength to resist any panel load tending to pull the panel away from the stud. Further, this structure in which the two flanges provide full engagement ensures proper alignment of the panels and virtually eliminates any looseness which could produce rattle.

Figure 6:
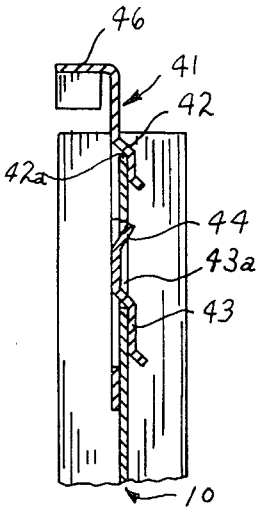
FIG. 6 is a fragmentary section alone line 6—6 of FIG. 5 illustrating the structure for securing the mounting clip on the stud.

Referring to FIGS. 5 and 6, the stud 10 is provided at its upper end with a mounting clip 41, which is secured by two lance tabs 42 and 43 in cooperation with a projection 44 to the upper end of the central web 23. As best illustrated in FIG. 6, the lance tab 42 fits over the top edge 42*a* of the web 23 and the lance tab 43 fits through an opening 43*a* and over the lower edge of such opening. The projection 44 also fits into the opening 43*a* and is engageable with its upper edge to prevent clip removal. This structure allows the clip 41 to be installed by merely sliding it down along the web until the projection 44 snaps into the opening 43*a*.

The upper end of the mounting clip 41 is bent to provide a horizontally extending flange 46 extending to opposed tabs 47 and 48, which angle downwardly from the plane of the flange 46 and terminate at free edges.

Referring to FIG. 3, the mounting clip 41 fits up into a channel formed in the upper or ceiling track 16 with the tabs 47 and 48 engaging associated shoulders 49 and 51, formed in the upper tracks 16 to permanently connect the mounting clip 41 in its installed position within the upper track 16. Connection is provided by merely pressing the mounting clip 41 upwardly into the channel of the upper track 16 until the edges of the two tabs 47 and 48 snap past the zone of least spacing and engage the associated shoulders 49 and 51. In such position, the stud is supported by the mounting clip from the upper track 16, and is capable of being moved lengthwise along the track during the installation process. The length of the stud 10 is preferably formed so that the lower end 52 is spaced upwardly from a lower U-shaped track element 53. This spacing between the floor track and the lower end of the stud accommodates variations in the floor-to-ceiling spacing and normally eliminates any need for on-site cutting of the studs.

Still referring to FIG. 3, the floor track assembly 53 includes the generally U-shaped track element 17 which is secured by a fastener 56 to the floor 57 and which provides opposite, upstanding legs 58 and 59 which engage the lower edge of the panels 14 of the rows 12 and 13, respectively. A screw fastener 60 is driven through the associated panels and into the associated legs 58 and 59 at intervals along the length of the panels and the channel member 53 to secure the lower edges of the panels in position. A pair of baseboard mounting clips 62 and 63 are provided with lower legs which are driven in under the channel 53 after the screws are installed to provide a mounting system for baseboard members 64 and 66. This lower track system is substantially the same as the corresponding track system disclosed in the copending application of Teli et al, Ser. No. 076,870, filed Sept. 19, 1979, and assigned to the assignee of this invention. Further, such application discloses a stud structure in which full backup of the panels is provided along portions which are not weakened by the kerfs.

The installation of the wall system incorporating the studs 10 is substantially as follows. The floor and ceiling tracks or channels 16 and 17 are installed along with a wall channel 86, illustrated in FIG. 2.

A pair of panels 14*a* are then installed with their upper edges extending inside the opposed, depending legs 88 of the ceiling channel, as best illustrated in FIG. 3, and the lower edges of the panels are secured to the lower track 53 by screws 60. Similarly, the edges of the panels 14*a* adjacent to the wall 89 are preferably secured to the wall channel 86 by screws 91.

The first stud 10 is then installed by inserting the clip 41 into the upper track and is moved along the ceiling track 16 until its outer flanges 19 extend into the kerf 92 formed in the edge of the panel. Because the studs 10 do not fit down into the floor channel, it is usually not necessary to perform any on-site cutting of the studs to proper length and variations in floor-to-ceiling spacing are accommodated by the spacing between the lower ends of the studs and the floor track. The subsequent pair of panels 14*b* are then installed and moved axially so that the flange 19 of the previously installed stud 10 fits into the kerf 18 along the edges of the panels 14*b*. Subsequently, a second stud is installed and moved into the kerfs 18 along the opposite edges of the panels 14*b*, and the process is continued until the entire wall panel system is completed.

The baseboard mounting clips 62 and baseboard 64 are then installed to finish the trim at the lower end of the wall and L-shaped finish clips 93 are installed to conceal the screws 91 and provide a finished appearance at the junction between the wall 89 and the wall that is being erected.

Although the preferred embodiment of this invention has been shown and described, it should be understood that various modifications and rearrangements of parts may be resorted to without departing from the scope of the invention as disclosed and claimed herein.

What is claimed is:

1. A stud for walls including a pair of spaced rows of panels, said stud comprising a single piece of sheet metal that provide a central web and panel engaging and suporting portions along each edge of said web, said piece of sheet metal being shaped so that said panel engaging and supporting portions each includes;

a first leg joined at one edge to one edge of said web and extending at a substantial angle therefrom to a reverse bend, a first flange portion extending from said reverse bend of said leg along a first plane forming a substantial angle to said web to its opposite edge, a shallow offset along the edge of said first flange portion opposite said first reverse bend extending inwardly of said stud, a second leg extending from said offset at a location spaced back from said first plane to a second reverse bend, a second flange portion extending from said second reverse bend along said first plane to a substantially right angle bend substantially adjacent to said offset, a flange joining portion extending from said first substantially right angle bend in a direction outwardly of said stud to a second substantially right angle bend, a third flange portion extending from said second right angle bend to a third reverse bend along a second plane spaced from and substantially parallel to said first plane, and a fourth flange portion extending from said third reverse bend past said second substantially right angle bend to an opposite edge, each of said first and second flanges being engageable with the inner surface of an associated pair of substantially abutting panels adjacent to their edges, said third and fourth flange portions being engageable with opposed surfaces of said pair of panels adjacent to their edges and being operable to maintain said inner surfaces against said first and second flanges, each first flange portion and its associated offset being spaced from said web and from said first leg except at said first bend whereby said leg provides a resilient connection between said flange portions and said web to resist transmission of vibration through said stud between said pair of spaced row of panels, said first and second flange portions extending laterally beyond said third and fourth flange portions.

2. A stud as set forth in claim 1, wherein a fourth reverse bend is formed along said opposite edge of said fourth flange portion to provide said fourth flange portion with a double metal thickness.

3. A stud as set forth in claim 1, in combination with a plurality of panels cooperating to provide two spaced rows of panels in which each row includes a pair of aligned panels substantially abutting along adjacent edges, said panels engaging and being supported by said panel engaging and panel supporting portions of said stud.

4. A stud and panel combination as set forth in claims 3, wherein said panels are formed with kerfs along their edges spaced from both the inner and outer surfaces of said panels, and said third and fourth flange portions extend into said kerfs.

5. A stud as set forth in claim 1, wherein said legs extend substantially perpendicular to said central web.

6. A stud as set forth in claim 1, wherein said web extends along a third plane substantially perpendicular to said first and second planes.

* * * * *